US007176396B1

(12) United States Patent
Chou

(10) Patent No.: US 7,176,396 B1
(45) Date of Patent: Feb. 13, 2007

(54) JERKING-INITIATED SWITCH

(76) Inventor: Tien-Ming Chou, No. 41, San-Hsi 5th St., Taichung City (TW)

( * ) Notice: Subject to any disclaimer, the term of this patent is extended or adjusted under 35 U.S.C. 154(b) by 0 days.

(21) Appl. No.: 11/446,463

(22) Filed: Jun. 2, 2006

(51) Int. Cl.
*H01H 35/02* (2006.01)
*H01H 35/14* (2006.01)

(52) U.S. Cl. ..... 200/61.52; 200/61.45 R

(58) Field of Classification Search ..... 200/61.45 R–61.53
See application file for complete search history.

(56) References Cited

U.S. PATENT DOCUMENTS 5,252,795 A * 10/1993 Su ..... 200/61.52
5,747,762 A * 5/1998 Fukuda et al. ..... 200/61.45 R
6,348,665 B1 * 2/2002 Ohashi et al. ..... 600/61.52
6,518,523 B1 * 2/2003 Chou ..... 200/61.52

* cited by examiner

*Primary Examiner*—K. Lee
(74) *Attorney, Agent, or Firm*—Frommer Lawrence & Haug LLP; Ronald R. Santucci

(57) ABSTRACT

A jerking-initiated switch includes two first shank members and two second shank members secured to first and second lateral sides of an insulating frame by virtue of engagement between a hole formed in each shank member and a terminal end disposed on the lateral side of the frame. Two limb members are integrally formed with the second shank members and extend toward the second shank members to terminate at threshold regions such that an electrically conductive ball rollably contacts the limb members. Each limb member has an idle region such that once the ball is jerked to displace from one of the idle and threshold regions to the other of the idle and threshold regions, the switch is placed in one of first and second switching states.

10 Claims, 16 Drawing Sheets

JERKING-INITIATED SWITCH

BACKGROUND OF THE INVENTION

1. Field of the Invention

This invention relates to a jerking-initiated switch, more particularly to a jerking-initiated switch having an electrically conductive ball rollable within an insulating frame to engage or disengage two pairs of electric contact terminals.

2. Description of the Related Art

Referring to FIGS. 1 and 2, a conventional jerking-initiated switch 100 is shown to include an insulating housing 101, an electrically conductive ball 102, four contact terminals 103, and a plug 104. In assembly, the ball 102 is received in the housing 101, and an access opening of the housing 101 is closed by the plug 104. Tapered contact ends 1031 of the contact terminals 103 are inserted into the housing 101 through four through holes 1041 in the plug 104 by using a tool (not shown). By contacting the ball 102 with the contact ends 1031 of two of the terminals 103, the electric contact between the terminals 103 can be established. However, since the terminals 103 are mounted on the plug 104 and are disposed in a suspended state, the operation of the tool for assembling the terminals 103 must be precise so as to align the contact ends 1031 with one another. Moreover, as the terminals 103 are not firmly secured in the plug 104, sensitivity of the switch 100 is unsteady.

The switch 100 can be mounted on a substrate 105 in an upright state shown in FIG. 2. The switch 100 can also be mounted under the substrate 105 by bending the terminals 103 such that an included angle (θ) is formed between the housing 101 and the substrate 105. The angle (θ) is liable to be changed by an external force to result in failure of the switch 100.

SUMMARY OF THE INVENTION

The object of the present invention is to provide a jerking-initiated switch which has contact terminals mounted in a steady manner, and which can achieve enhanced sensitivity.

According to this invention, the jerking-initiated switch includes an insulating frame which includes a base wall and first and second upright walls extending respectively from first and second lateral sides of the walls to define a rolling path. An electrically conductive ball is disposed to be rollable along the rolling path between first and second switching positions where the jerking-initiated switch is in first and second switching states, respectively. An interconnecting member is secured to the first lateral side, and extends to terminate at front and rear joining ends. Front and rear first shank members, which are made from an electrically conductive material, respective have front and rear first joints that are respectively connected to the front and rear joining ends. The first shank members extend to terminate at first contact terminals, respectively, which extend outwardly of the frame to be in electric contact with a substrate. Front and rear second shank members, which are made from an electrically conductive material, are secured to the second lateral side, and are spaced apart from each other. The second shank members extend to terminate at second contact terminals, respectively, which extend outwardly of the frame to be in electric contact with the substrate. The second shank members have front and rear second joints that are opposite to the front and rear second contact terminals, respectively. Front and rear limb members are respectively and integrally formed with the front and rear second joints, extend respectively from the front and rear second joints to form a guideway along the rolling path such that the ball can slidably contact the front and rear limb members, and extend respectively towards the first joints to terminate at front and rear threshold regions, respectively. The front and rear threshold regions are spaced apart from the first joints, respectively, and correspond to the first switching position. The front and rear limb members respectively have front and rear idle regions which are configured to correspond to the second switching position such that once the ball is caused to displace from one of the idle and threshold regions to the other of the idle and threshold regions in response to a jerking action, the switch is placed into one of the first and second switching states.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
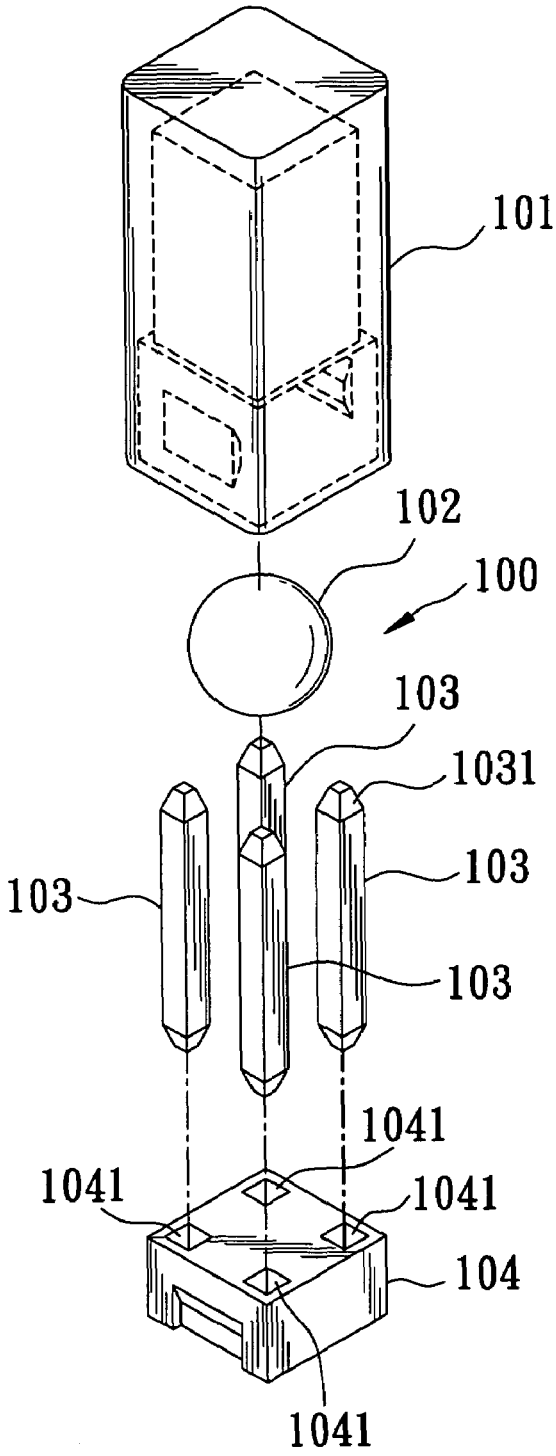
FIG. 1 PRIOR ART
FIG. 1 is an exploded perspective view of a conventional jerking-initiated switch.
Figure 2:
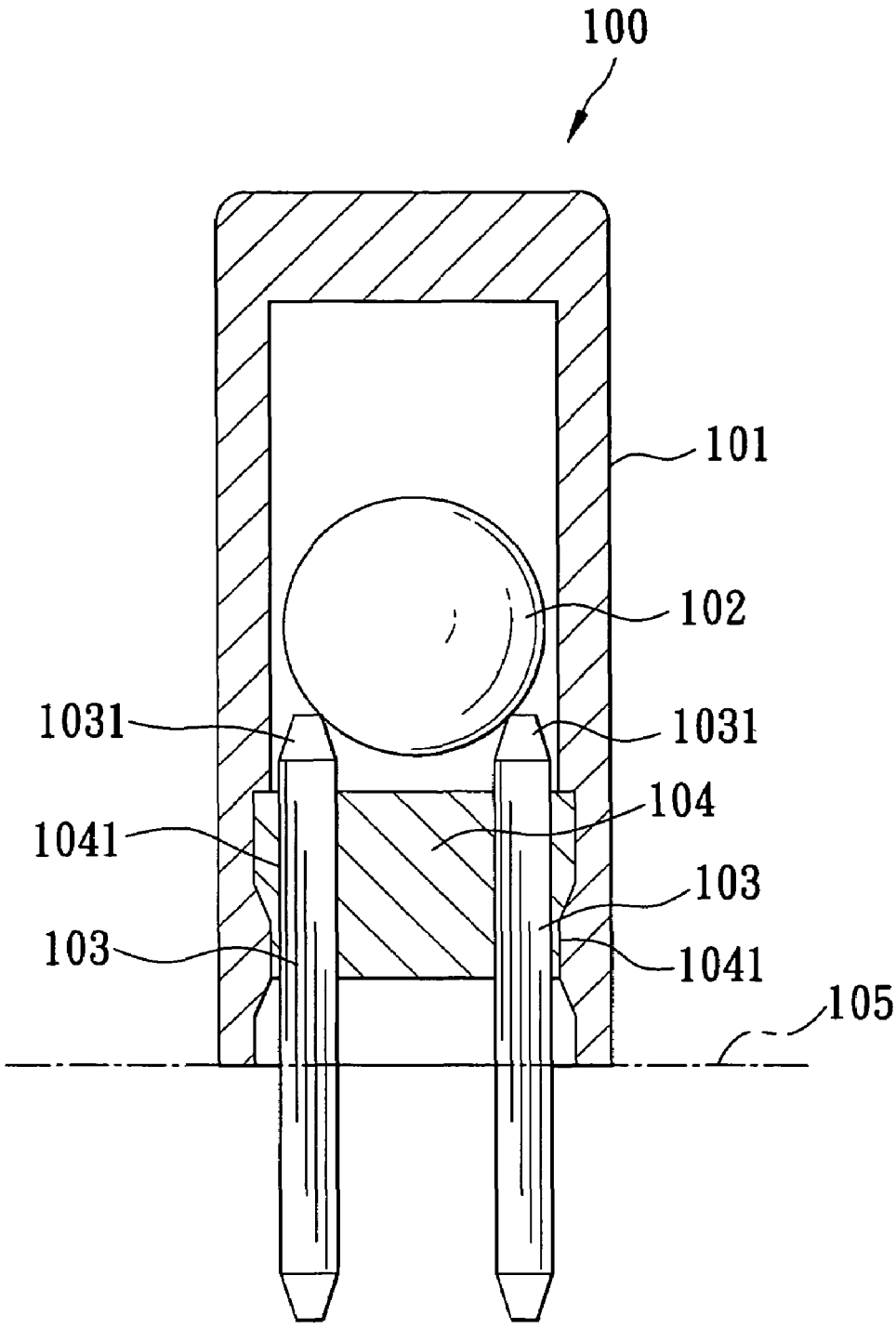
FIG. 2 PRIOR ART
FIG. 2 is a sectional view of the conventional jerking-initiated switch mounted on a substrate.
Figure 3:
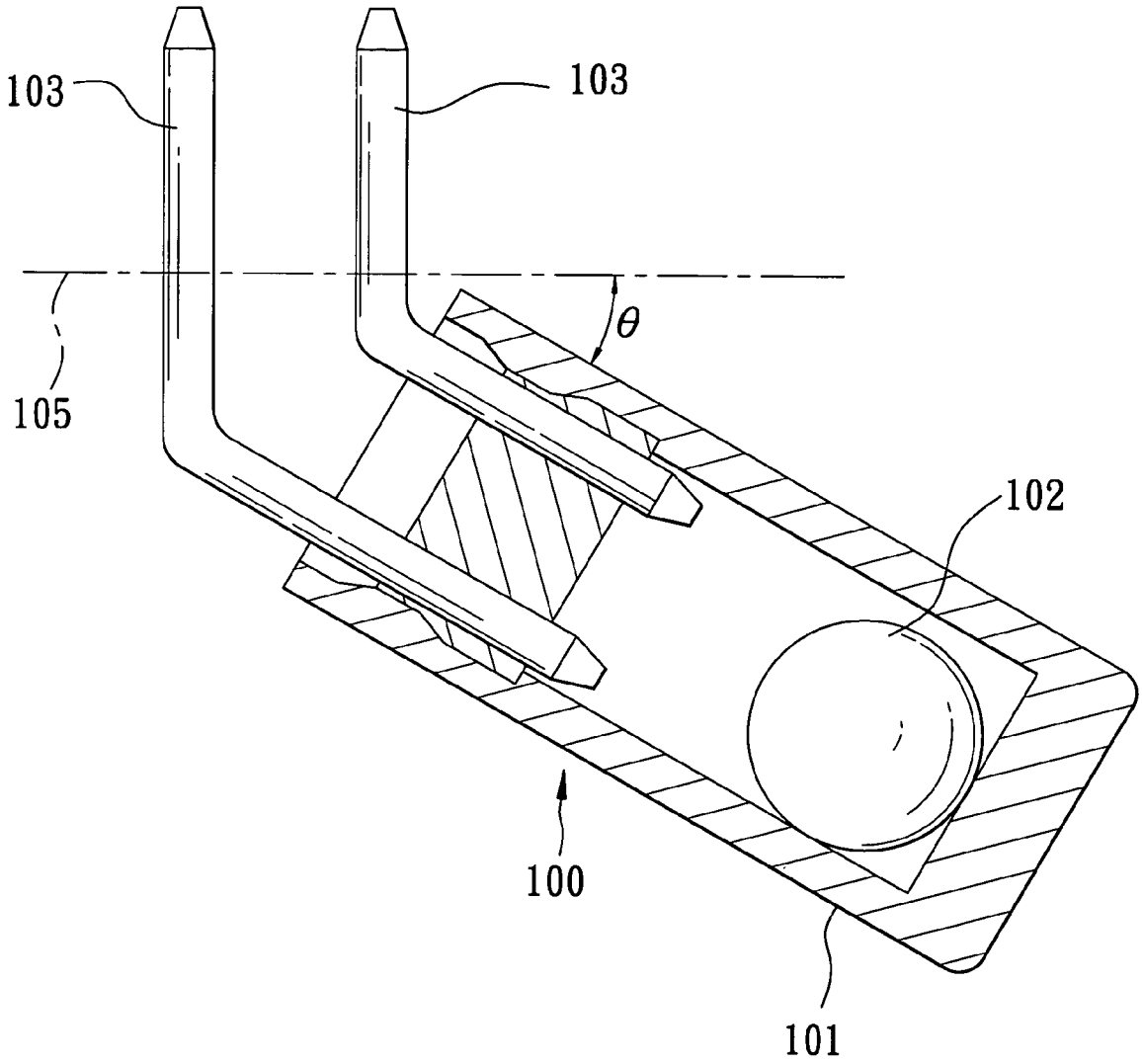
FIG. 3 PRIOR ART
FIG. 3 is a sectional view of the conventional jerking-initiated switch mounted under a substrate.

Before the present invention is described in greater detail, it should be noted that same reference numerals have been used to denote like elements throughout the specification.

Figure 4:
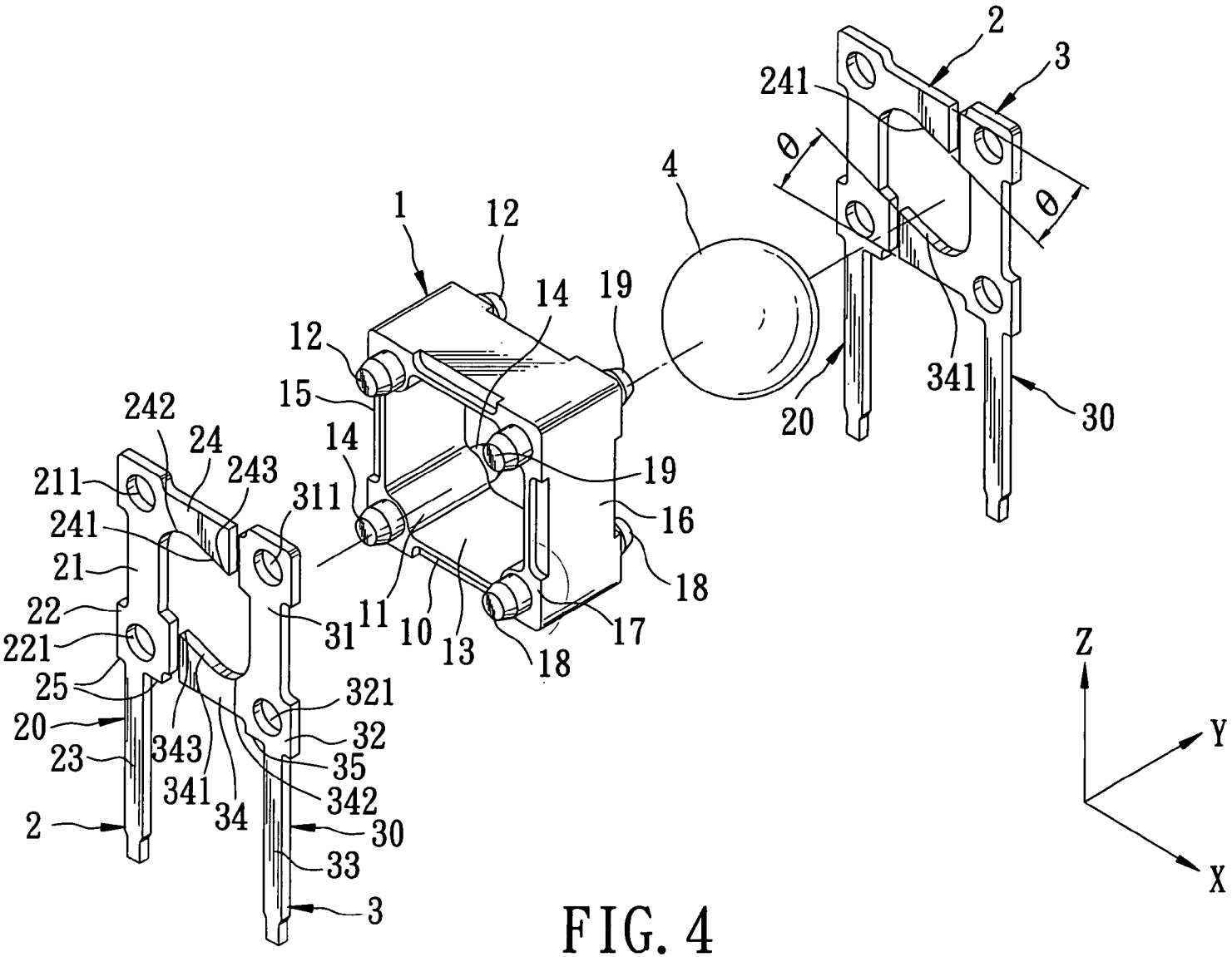
FIG. 4 is an exploded perspective view of the first preferred embodiment of a jerking-initiated switch according to this invention.
Figure 5:
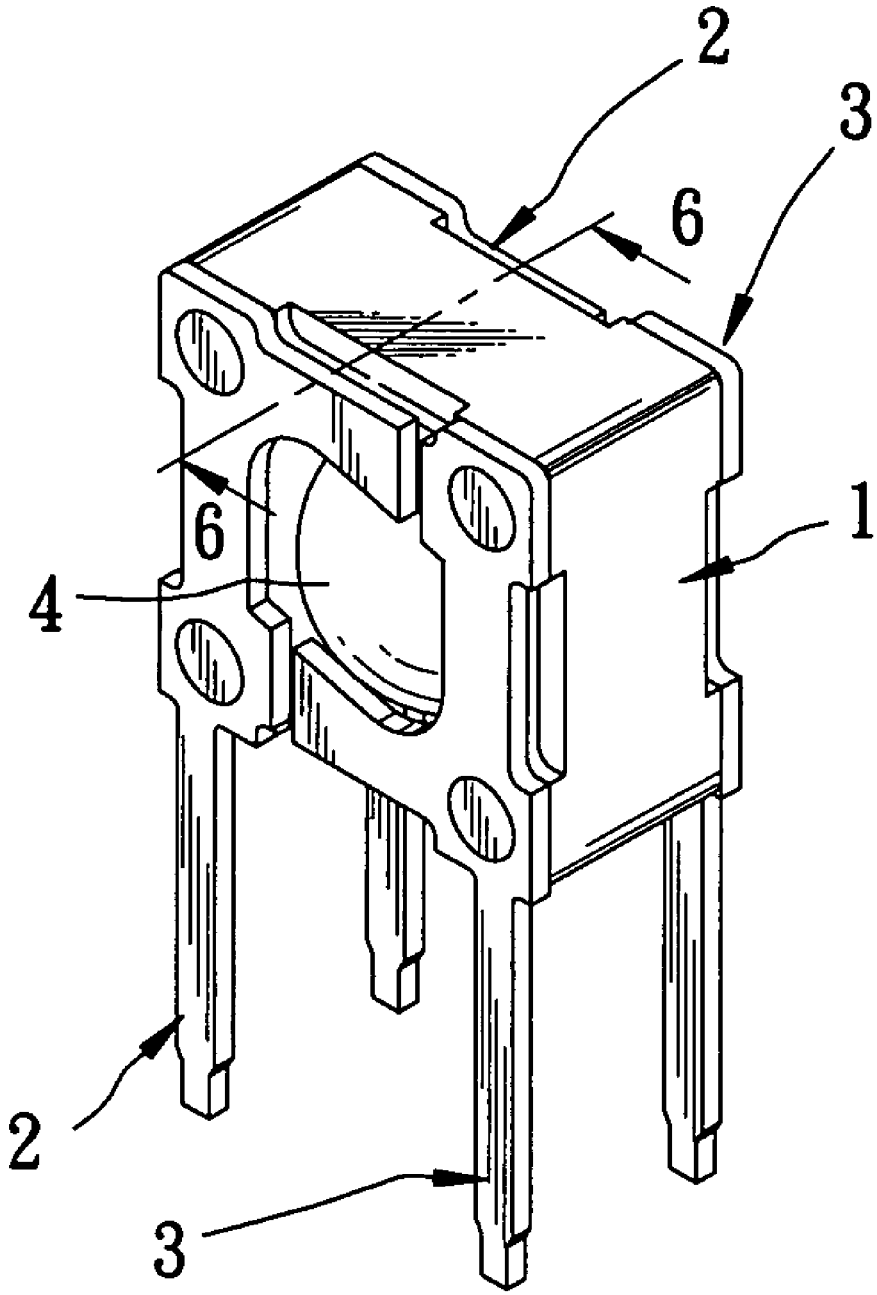
FIG. 5 is a perspective view of the first preferred embodiment.
Figure 6:
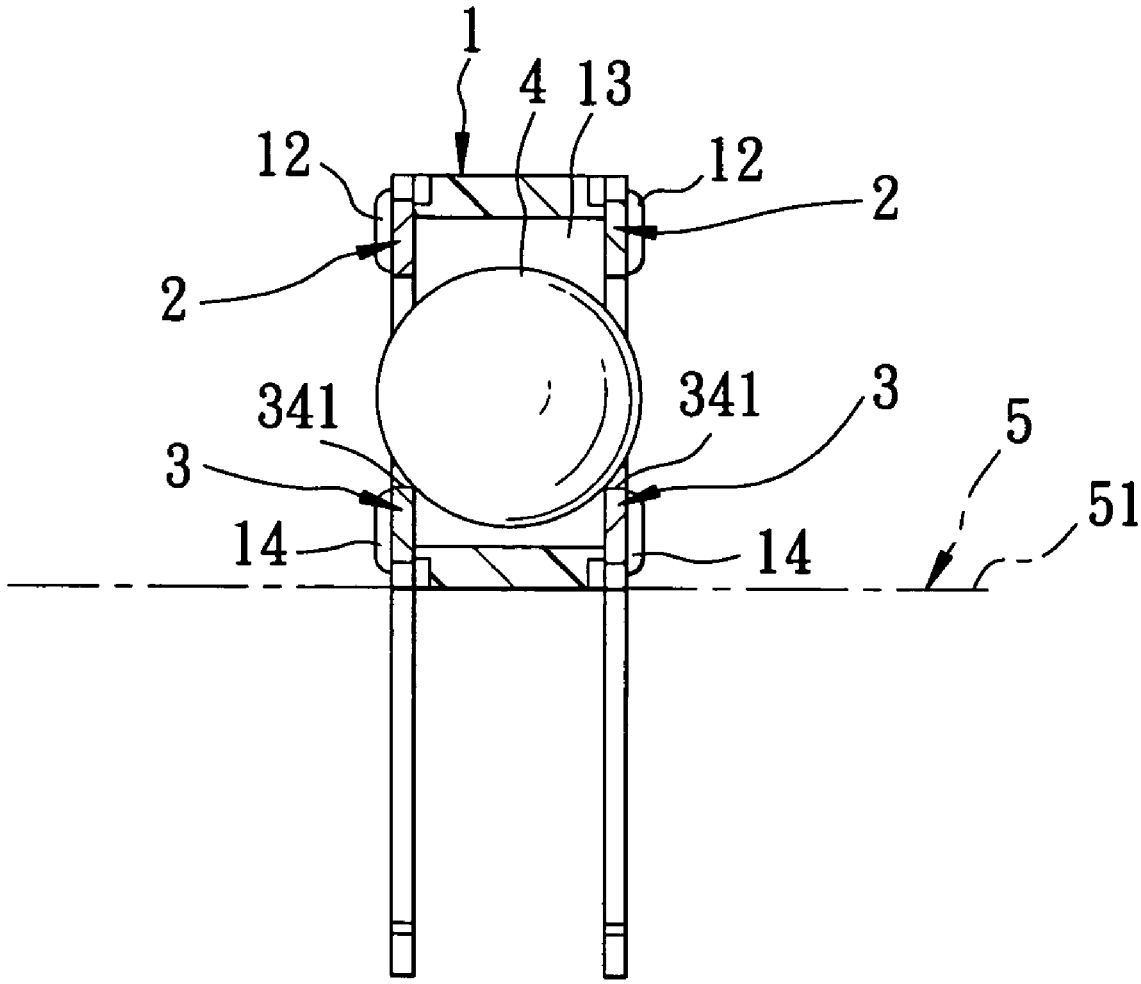
FIG. 6 is a sectional view of the first preferred embodiment taken along lines 6—6 of FIG. 5.

Referring to FIGS. 4 to 6, the first preferred embodiment of a jerking-initiated switch according to the present invention is shown to comprise an insulating frame 1, an electrically conductive ball 4, front and rear first terminal units 2, and front and rear second terminal units 3.

The frame 1 includes a base wall 10 which has first and second lateral sides opposite to each other in a longitudinal direction (X), and front and rear sides opposite to each other in a first transverse direction (Y) transverse to the longitudinal direction (X), and first and second upright walls 15,16 which extend respectively from the first and second lateral sides in a second transverse direction (Z) that is transverse to both the first transverse direction (Y) and the longitudinal direction (X) to confine a receiving chamber 13 that defines a rolling path therein. A first interconnecting member 11 is integrally formed with the first lateral side of the base wall 10, and extends in the first transverse direction (Y) to terminate at front and rear first joining ends 14. A second interconnecting member 17 is integrally formed with the second lateral side of the base wall 20, and extends in the first transverse direction (Y) to terminate at front and rear second joining ends 18.

The ball 4 is received in the receiving chamber 13 to be rollable along the rolling path between first and second switching positions where the switch is in first and second switching states, respectively, which will be described in greater detail in the succeeding paragraphs.

Each of the front and rear first terminal units 2 is made from an electrically conductive material to have a one-piece construction, and includes a front (rear) first shank member 20, a front (rear) first thigh member 21, and a front (rear) branch member 24. The front (rear) first shank member 20 has a front (rear) first joint 22 with a first insert hole 221 which extends in the first transverse direction (Y) such that the front (rear) first joining end 14 is inserted into the first insert hole 221 to secure the front (rear) first terminal unit 2 to the frame 1. The front (rear) first shank member extends from the front (rear) first joint 22 in the second transverse direction (Z) to terminate at a front (rear) first contact terminal 23 that extends outwardly of the frame 1 to electrically contact a substrate 5. A first shoulder portion is disposed between the front (rear) first joint 22 and the front (rear) first contact terminal 23. The front (rear) first thigh member 21 extends from the front (rear) first joint 22 away from the front (rear) first contact terminal 23, and has a first insert hole 211 to receive a front (rear) protrusion 12 that extends from the first upright wall 15 in the first transverse direction (Y), thereby enhancing attachment of the front (rear) first terminal unit 2 to the frame 1. The front (rear) branch member 24 is integrally formed with and extends from the front (rear) first thigh member 21 in the longitudinal direction (X) towards the front (rear) second terminal unit 3.

Each of the front and rear second terminal units 3 is made from an electrically conductive material to have a one-piece construction, and includes a front (rear) second shank member 30, a front (rear) second thigh member 31, and a front (rear) limb member 34. The front (rear) second shank member 30 has a front (rear) second joint 32 with a second insert hole 321 which extends in the first transverse direction (Y) such that the front (rear) second joining end 18 is inserted into the second insert hole 321 to secure the front (rear) second terminal unit 3 to the frame 1. The front (rear) second shank member 30 extends from the front (rear) second joint 32 in the second transverse direction (Z) to terminate at a front (rear) second contact terminal 33 that extends outwardly of the frame 1 to electrically contact the substrate 5. A second shoulder portion 35 is disposed between the front (rear) second joint 32 and the front (rear) second contact terminal 33. The front (rear) second thigh member 31 extends from the front (rear) second joint 32 away from the front (rear) second contact terminal 33, and has a second insert hole 311 to receive a front (rear) protrusion 19 extending from the second upright wall 16 in the first transverse direction (Y), thereby enhancing attachment of the front (rear) second terminal unit 3 to the frame 1. The front and rear limb members 34 are integrally formed with and extend respectively from the front and rear second joints 32 in the longitudinal direction (X) to cooperatively form a guideway 341 along the rolling path such that the ball 4 can slidably contact the front and rear limb members 34. The front and rear limb members 34 extend towards the front and rear first joints 22, respectively, to terminate at front and rear threshold regions 343, respectively. The front and rear threshold regions 343 are spaced apart from the front and rear first joints 22, respectively, and correspond to the first switching position. The front and rear limb members 34 respectively have front and rear idle regions 342 which are configured to correspond to the second switching position. Similarly, the front and rear branch members 24 cooperate to form an auxiliary guideway 241 such that the ball 4 can slideably contact the front and rear branch members 24. The front and rear branch members 24 extend to terminate at front and rear threshold regions 243, respectively, which are spaced apart from the front and rear second thigh members 31, and which correspond to the first switching position. The front and rear branch members 24 respectively have front and rear idle regions 242 which are configured to correspond to the second switching position. Each of the front and rear limb members 34 and the front and rear branch members 24 is in the form of a plate which has two major surfaces opposite to each other in the first transverse direction (Y).

Figure 7:
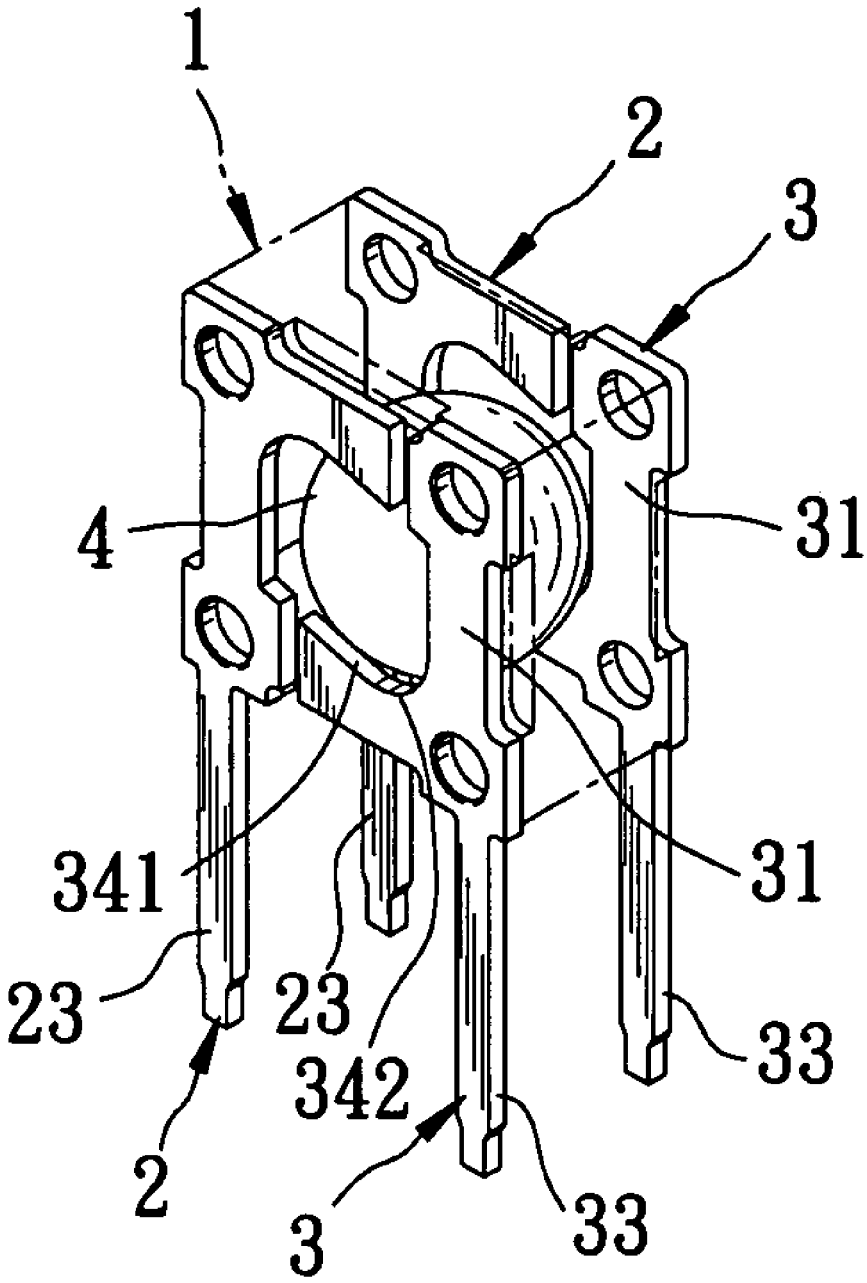
FIG. 7 is a schematic perspective view of the first preferred embodiment in a rest state.

In this embodiment, each of the front and rear limb members 34 and the front and rear branch members 24 is configured to ascend from the respective idle region 342,242 to the respective threshold region 343,243 in the longitudinal direction (X) by an angle (θ) about 15 degrees. Therefore, as shown in FIGS. 5 to 7, when the switch is mounted uprightly on an upper surface 51 of the substrate 5, the ball 4 can rest on the idle regions 342 to place the switch in the second switching state, where the second contact terminals 33 are not electrically connected to the first contact terminals 23.

Figure 8:
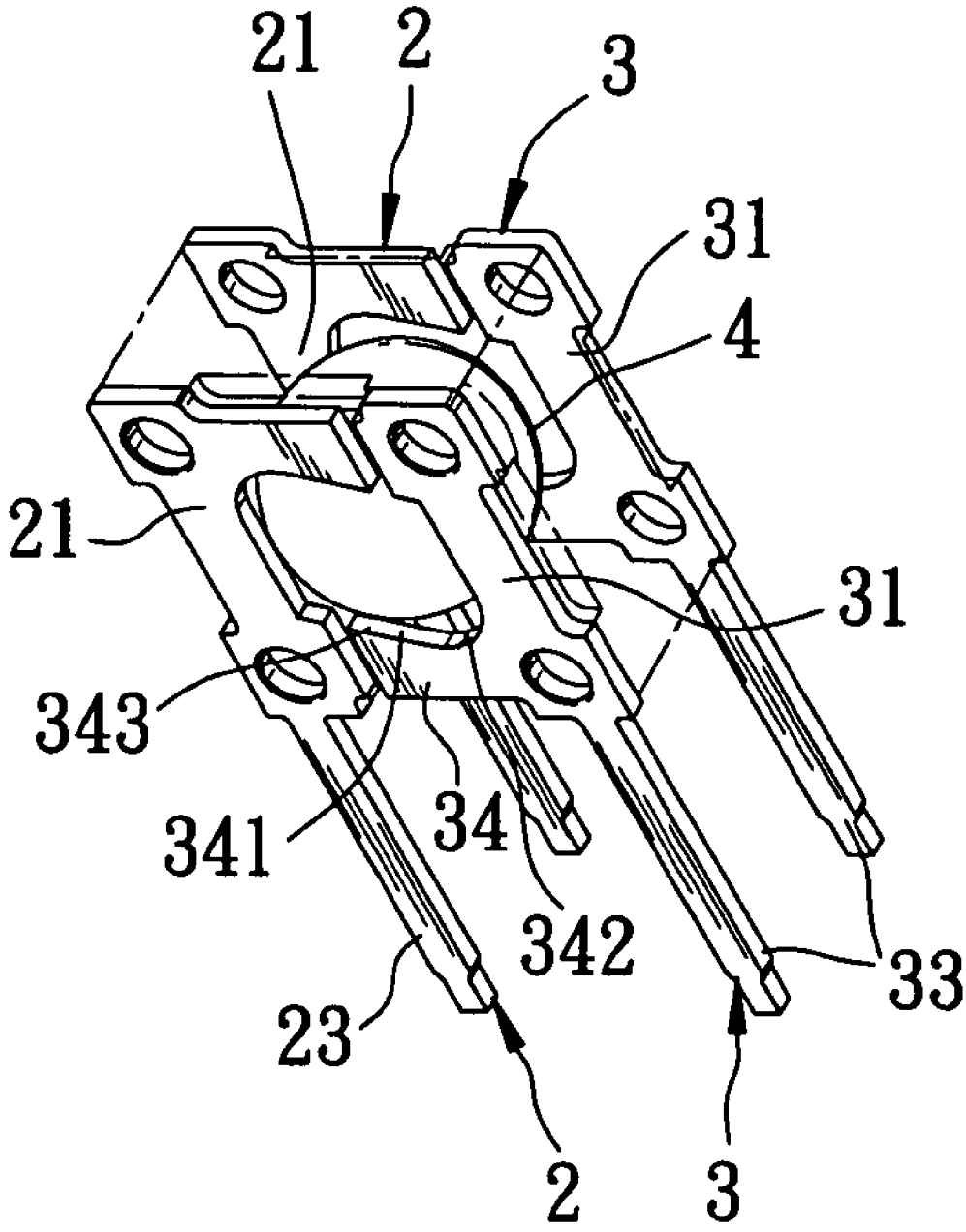
FIG. 8 is a schematic perspective view of the first preferred embodiment in a tilted state.

As shown in FIG. 8, a jerking action will cause the switch to tilt, so that the ball 4 displaces from the idle regions 342 to the threshold regions 343 and comes into contact with the front and rear first terminal units 2, thereby placing the switch in the first switching state, where the second contact terminals 33 are electrically connected to the first contact terminals 23 through the ball 4.

Figure 9:
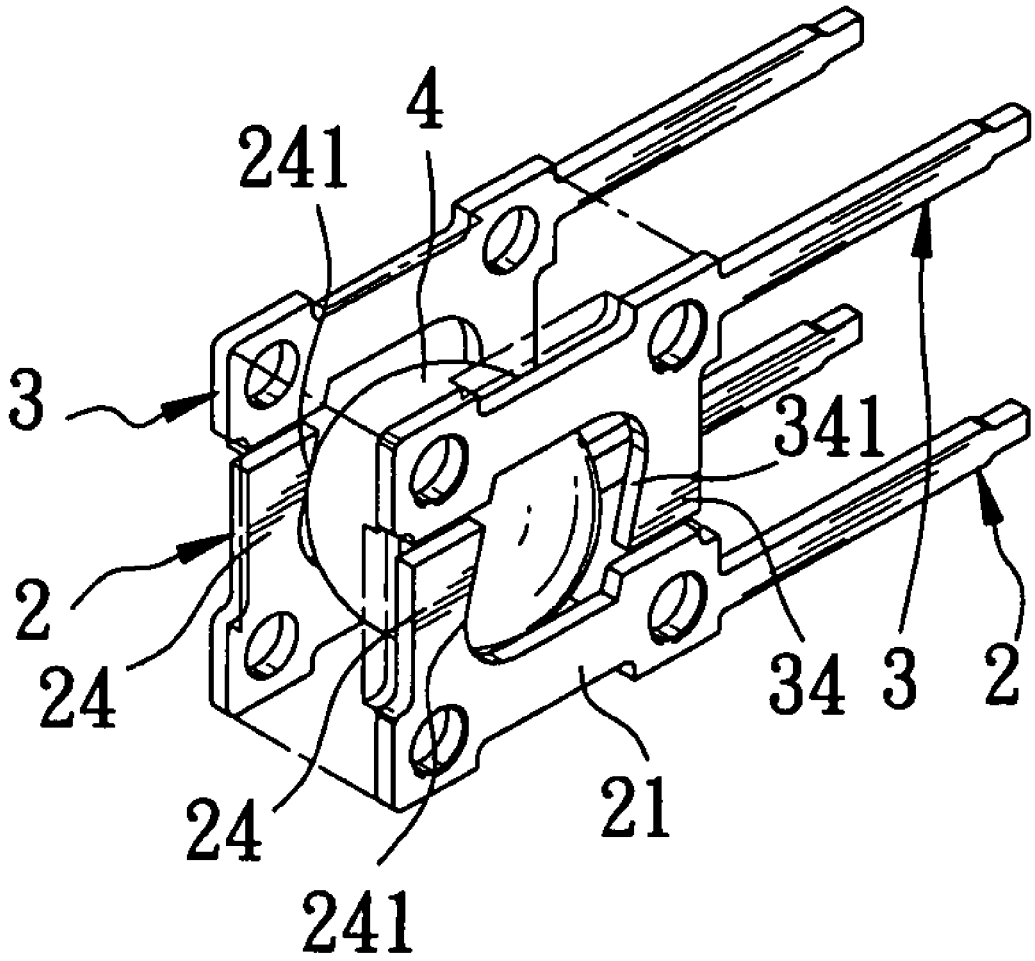
FIG. 9 is a schematic perspective view of the first preferred embodiment in another tilted state.

Thereafter, as shown in FIG. 9, once the switch is tilted to about 90 degrees, the ball 4 will roll to the branch members 24 to rest on the corresponding idle regions 242, thereby placing the switch in the second switching state, where the electric connection between the first and second contact terminals 23,33 is cut off.

Figure 10:
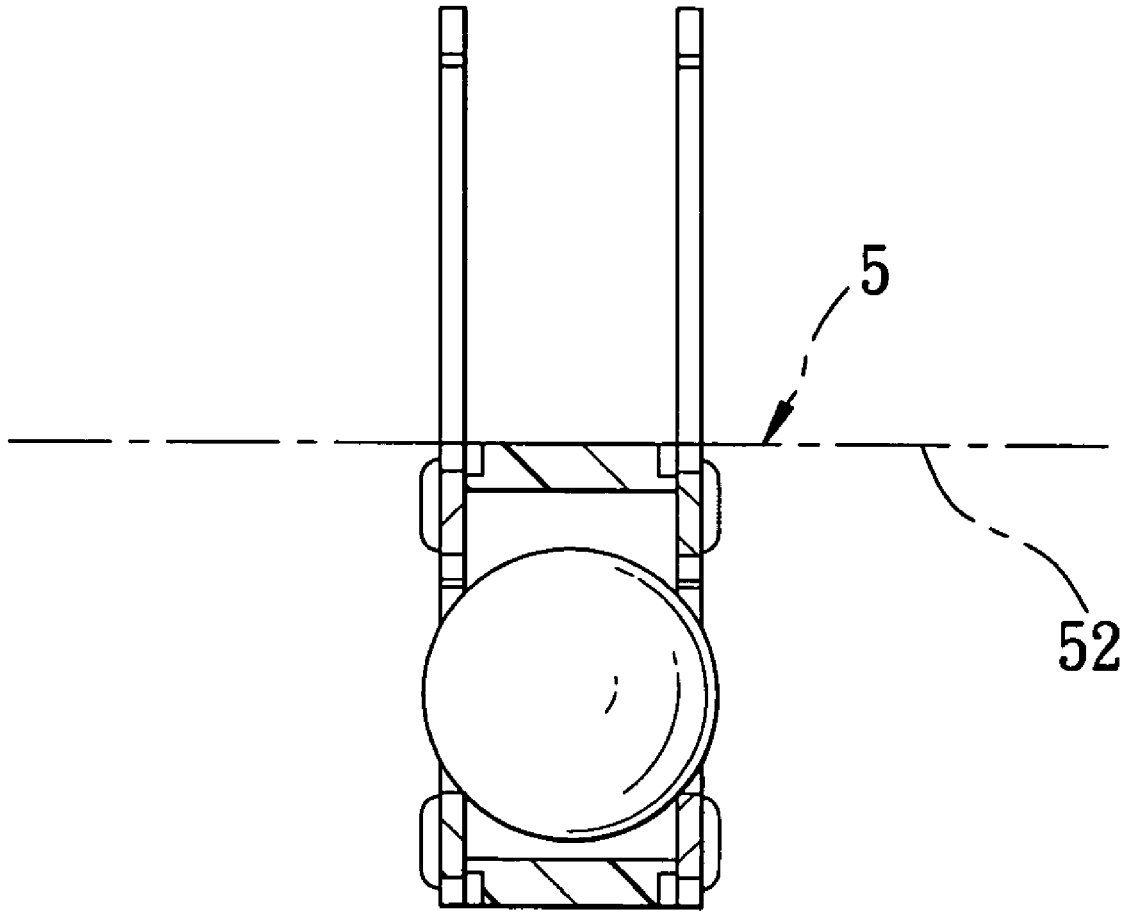
FIG. 10 is a view similar to FIG. 6 but showing the first preferred embodiment mounted under a substrate.

As shown in FIG. 10, it is noted that the switch of the first embodiment can also be mounted on a lower surface 52 of a substrate 5, and the above-described effect can likewise be achieved.

As illustrated, as compared with the conventional switch 100, the first and second terminal units 2, 3 in this invention are fitted into the frame 1 individually, and are retained therein by virtue of the engagement between the insert holes 221,211,321,311 of the first and second terminal units 2,3 and the protrusions 12,19 and the joining ends 14,18 on the frame 1. Thus, the problem associated with alignment of the terminals 103 in the housing 101 of the conventional switch 100 can be overcome, and the terminal units 2,3 can be retained on the frame 1 steadily and firmly. In addition, since the limb members 34 and the branch members 24 are of a plate shape, the area of contact between the ball 4 and one of the limb members 34 and the branch members 24 is increased to result in enhanced electric contact, and improved sensitivity. Furthermore, the switch of this invention can be assembled onto the substrate 5 at a desired angle by varying the angle (θ).

Figure 11:
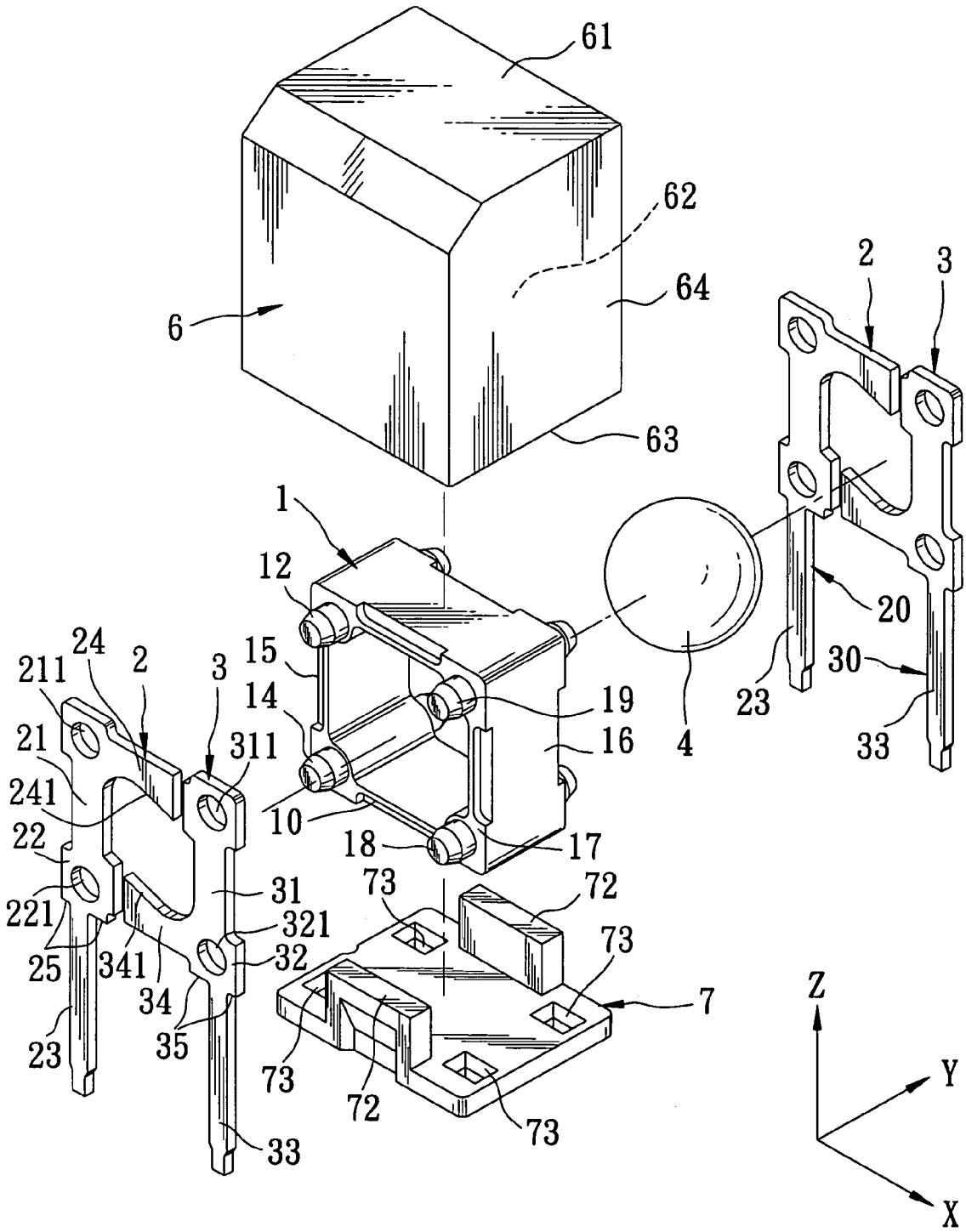
FIG. 11 is an exploded perspective view of the second preferred embodiment of a jerking-initiated switch according to this invention.
Figure 12:
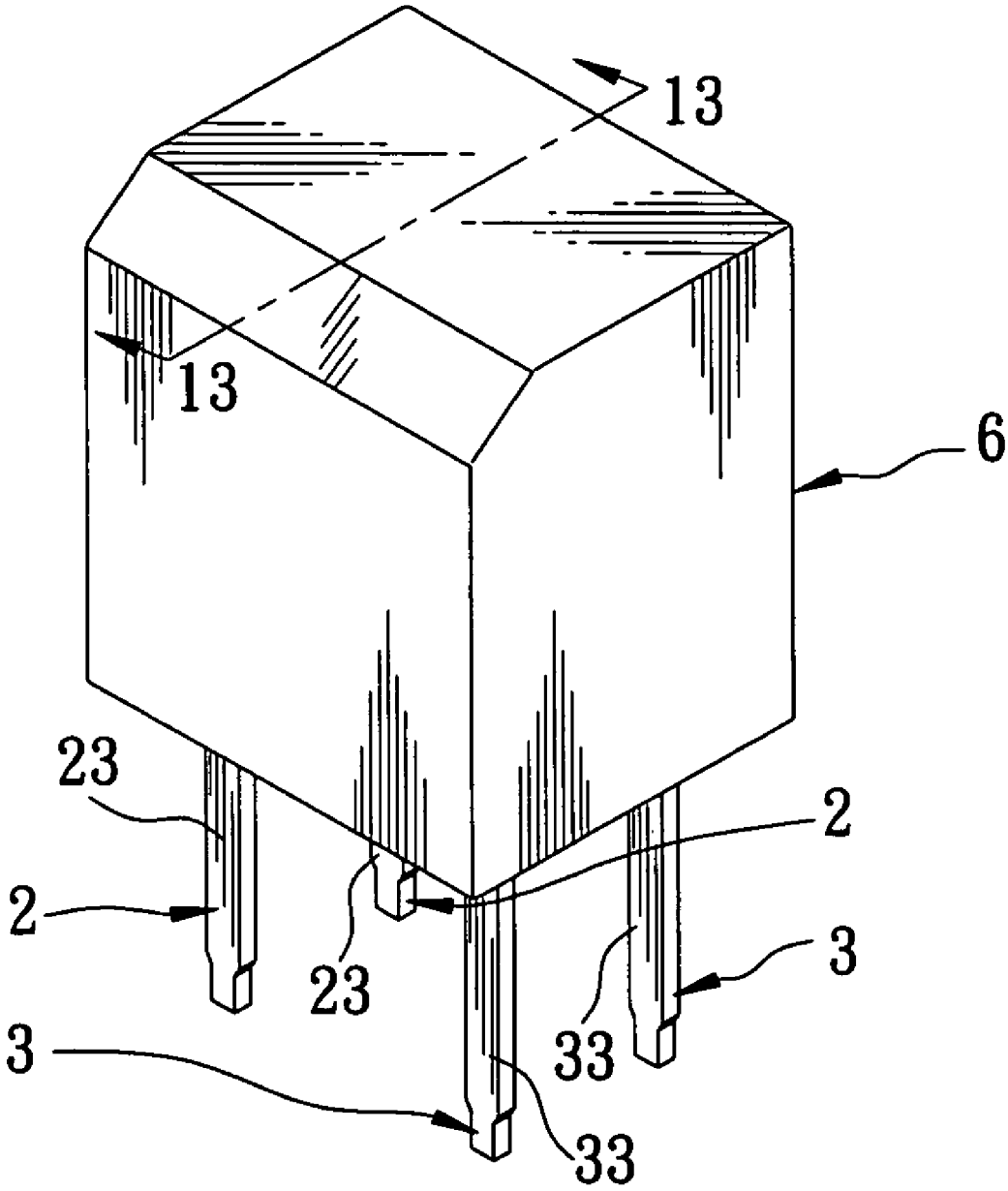
FIG. 12 is a perspective view of the second preferred embodiment.
Figure 13:
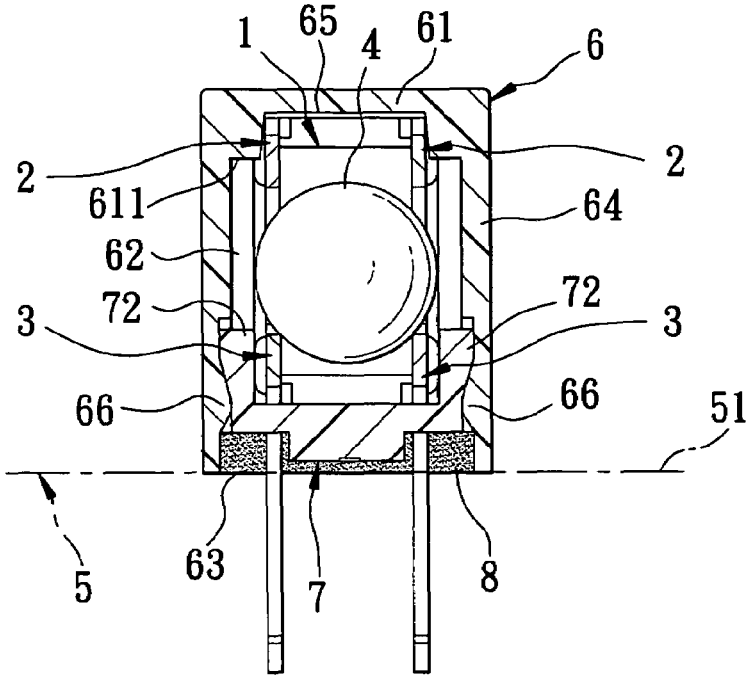
FIG. 13 is a sectional view of the second preferred embodiment taken along lines 13—13 of FIG. 12 and mounted on a substrate.

Referring to FIGS. 11 to 13, the second preferred embodiment of a jerking-initiated switch according to this invention is shown to be similar to the first embodiment in construction. In the second embodiment, the switch further comprises an insulating shell 6 and an insulating cover 7. The shell 6 includes a base 61 and a surrounding wall 64 which extends from a periphery of the base 61 in the second transverse direction (Z) to define an accommodation chamber 62 and an access opening 63 such that the frame 1 is inserted into the accommodation chamber 62 through the access opening 63. The surrounding wall 64 has a recess 65 formed in an inner surface 611 for receiving portions of the first and second terminal units 2,3, and two projecting blocks 66 formed on the inner surface 611 adjacent to the access opening 63.

The cover 7 is disposed to close the access opening 63, and has four through holes 73 formed therethrough in the second transverse direction (Z) such that the front and rear first and second contact terminals 23,33 extend through the through holes 73, respectively. The cover 7 further has two projecting blocks 72 which are disposed to interengage the projecting blocks 66 so as to firmly secure the cover 7 to the surrounding wall 64, as shown in FIG. 13. It is noted that when the cover 7 is disposed to close the access opening 63, the cover 7 is brought to abut against the first and second shoulder portions 25,35. Adhesive 8 can be introduced into the clearances between the holes 73 and the terminals 23,33 and the clearances between the cover 7 and the surrounding wall 64 for sealing purposes.

Figure 14:
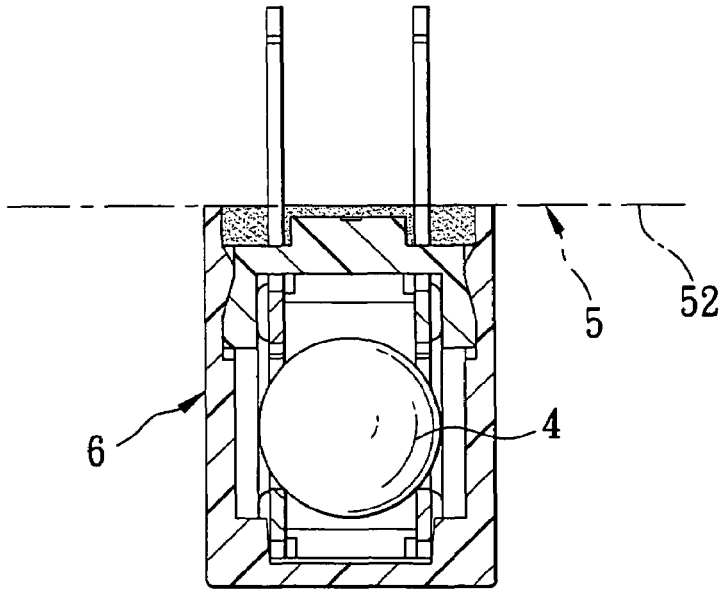
FIG. 14 is a view similar to FIG. 13 but showing the second preferred embodiment mounted under a substrate.

In FIG. 13, the switch of the second embodiment is mounted on an upper surface 51 of the substrate 5. Alternatively, the switch of this embodiment can also be mounted on a lower surface 52 of the substrate 5, as shown in FIG. 14.

Figure 15:
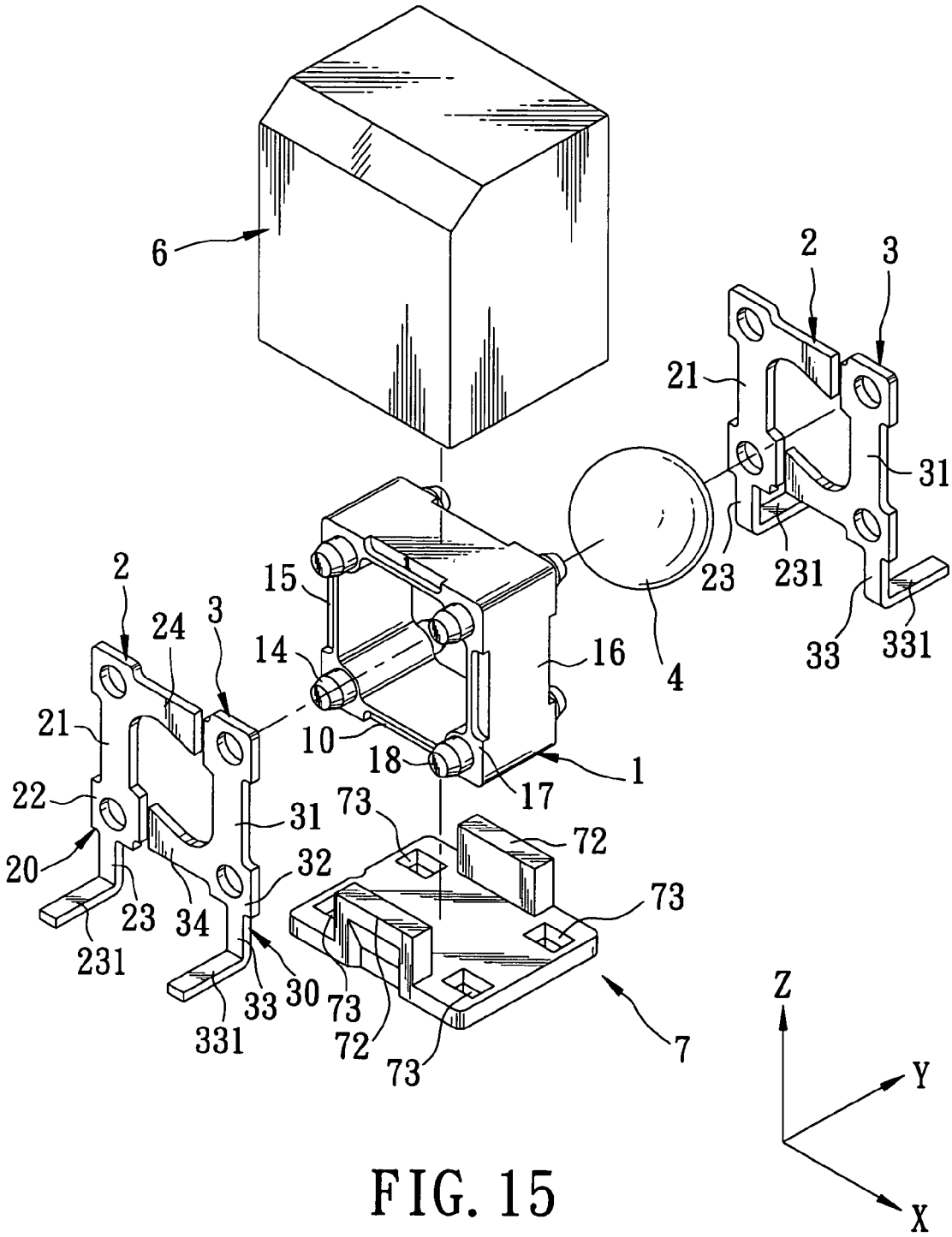
FIG. 15 is an exploded perspective view of the third preferred embodiment of a jerking-initiated switch according to this invention.
Figure 16:
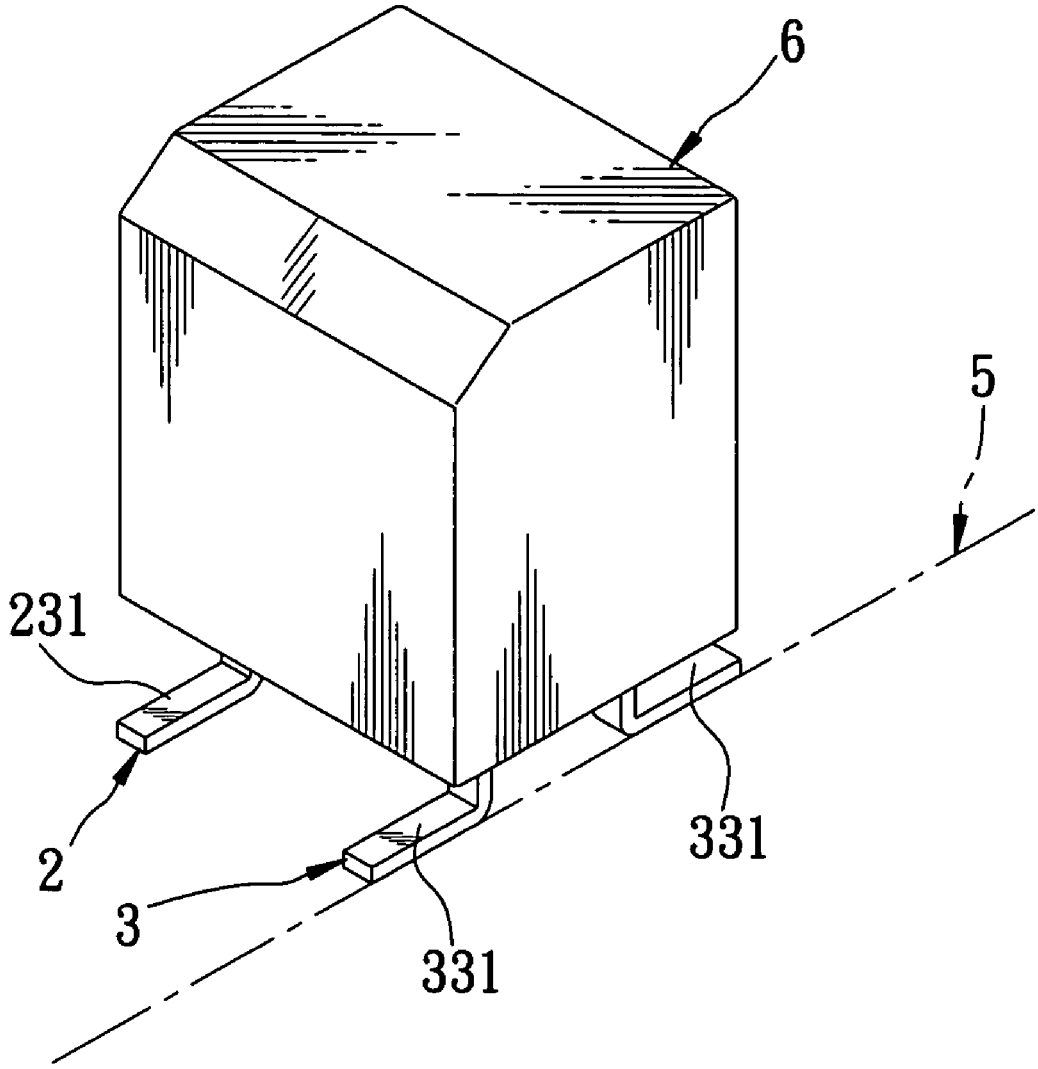
FIG. 16 is a perspective view of the third preferred embodiment.

Referring to FIGS. 15 and 16, the third preferred embodiment of a jerking-initiated switch according to this invention is shown to be similar to the second embodiment in construction. In the third embodiment, each of the front and rear first and second contact terminals 23,33 has a contact end 231,331 which is bent to extend in the first transverse direction (Y) and which has a major surface that is adapted to be attached to the substrate 5 using a conventional SMT (surface mount technology) process.

Figure 17:
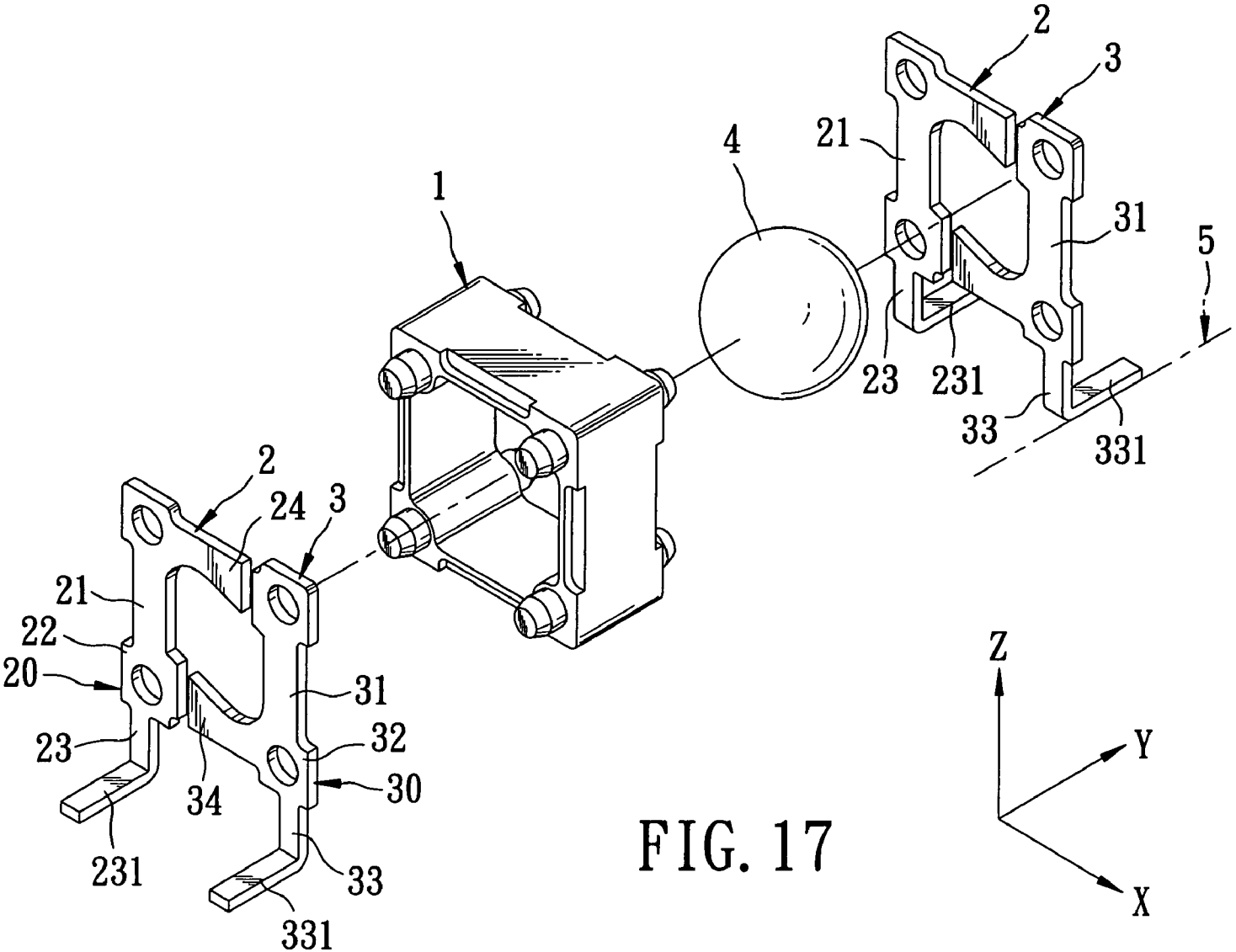
FIG. 17 is an exploded perspective view of the fourth preferred embodiment of a jerking-initiated switch according to this invention.

Referring to FIG. 17, the fourth preferred embodiment of a jerking-initiated switch according to this invention is shown to be similar to the first embodiment in construction so as to be adapted for mounting on a substrate 5. In the fourth embodiment, each of the front and rear first and second contact terminals 33,23 has a contact end 331,231 which is bent to extend in the first transverse direction (Y) and which has a major surface that is adapted to be attached to the substrate 5 using a conventional SMT process.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A jerking-initiated switch adapted to be mounted on and to be in electric contact with a substrate, said jerking-initiated switch comprising:

an insulating frame which includes a base wall that has first and second lateral sides opposite to each other in a longitudinal direction, and front and rear sides opposite to each other in a first direction transverse to the longitudinal direction, and first and second upright walls extending respectively from said first and second lateral sides in a second direction transverse to both the first transverse direction and the longitudinal direction to define therebetween a rolling path;

an electrically conductive ball disposed to be rollable along said rolling path between first and second switching positions where said jerking-initiated switch is in first and second switching states, respectively;

a first interconnecting member which is secured to said first lateral side, and which extends in the first transverse direction to terminate at front and rear first joining ends;

front and rear first shank members which are made from an electrically conductive material, which respectively have front and rear first joints that are respectively connected to said front and rear first joining ends, and which extend from said front and rear first joints in the second transverse direction to terminate at front and rear first contact terminals, respectively, said front and rear first contact terminals extending outwardly of said frame to be in electric contact with the substrate;

front and rear second shank members which are made from an electrically conductive material, and which are respectively secured to said second lateral side, said front and rear second shank members being spaced apart from each other in the first transverse direction, and being disposed to extend in the second transverse direction to terminate at front and rear second contact terminals, respectively, that extend outwardly of said frame to be in electric contact with the substrate, and at front and rear second joints that are opposite to said front and rear second contact terminals, respectively; and front and rear limb members which are respectively and integrally formed with said front and rear second joints, which extend respectively from said front and rear second joints in the longitudinal direction to cooperatively form a guideway along said rolling path such that said ball can slidably contact said front and rear limb members, and which extend respectively towards said front and rear first joints to terminate at front and rear threshold regions, respectively, said front and rear threshold regions being spaced apart from said front and rear first joints, respectively, and corresponding to the first switching position, said front and rear limb members respectively having front and rear idle regions which are configured to correspond to the second switching position such that once said ball is caused to displace from one of said idle and threshold regions to the other of said idle and threshold regions in response to a jerking action, said switch is placed into one of the first and second switching states.

2. The jerking-initiated switch of claim 1, wherein said first interconnecting member is integrally formed with said base wall of said frame.

3. The jerking-initiated switch of claim 2, wherein said front and rear first joining ends extend from said first lateral side in the first transverse direction, each of said front and rear first joints having a first insert hole which extends in the first transverse direction such that a respective one of said front and rear first joining ends is inserted into said first insert hole so as to secure said front and rear first shank members to said first interconnecting member.

4. The jerking-initiated switch of claim 3, further comprising a second interconnecting member which is integrally formed with said second lateral side of said base wall and which extends in the first transverse direction to terminate at front and rear second joining ends, each of said front and rear second joints having a second insert hole which extends in the first transverse direction such that a respective one of said front and rear second joining ends is inserted into said second insert hole so as to secure said front and rear second shank members to said second interconnecting member.

5. The jerking-initiated switch of claim 2, further comprising front and rear second thigh members which extend respectively from said front and rear second joints away from said front and rear second contact terminals, and which are configured to be anchored on said second upright wall, thereby enhancing attachment of said front and rear limb members to said frame.

6. The jerking-initiated switch of claim 5, further comprising front and rear first thigh members which extend respectively from said front and rear first joints away from said front and rear first contact terminals, said switch further comprising front and rear branch members which are respectively and integrally formed with and which respectively extend from said front and rear first thigh members in the longitudinal direction to cooperatively form an auxiliary guideway such that said ball can slideably contact said front and rear branch members, and which are spaced apart from said front and rear second thigh members in the longitudinal direction.

7. The jerking-initiated switch of claim 6, wherein each of said front and rear limb members and said front and rear branch members is in form of a plate which has two major surfaces opposite to each other in the first transverse direction.

8. The jerking-initiated switch of claim 6, further comprising:

a shell including a base and a surrounding wall which extends from a periphery of said base in the second transverse direction to define an accommodation chamber and an access opening such that said frame is inserted into said accommodation chamber through said access opening; and a cover disposed to close said access opening, and having four through holes formed therethrough in the second transverse direction such that said front and rear first and second contact terminals extend through said through holes, respectively.

9. The jerking-initiated switch of claim 8, wherein each of said front and rear first shank members has a first shoulder portion which is disposed between a respective one of said front and rear first joints and a respective one of said front and rear first contact terminals, each of said front and rear second shank members having a second shoulder portion which is disposed between a respective one of said front and rear second joints and a respective one of said front and rear second contact terminals such that said cover is brought to abut against said first and second shoulder portions when said cover closes said access opening.

10. The jerking-initiated switch of claim 1, wherein each of said front and rear first and second contact terminals has a bent contact end which extends in the first transverse direction to be adapted to abut against the substrate.

* * * * *